US005911674A

United States Patent [19]

Stahlecker et al.

[11] Patent Number: 5,911,674

[45] Date of Patent: Jun. 15, 1999

[54] SPINDLE FOR A SPINNING OR TWISTING MACHINE

[75] Inventors: Gerd Stahlecker, Eislingen/Fils; Hans Braxmeier, Süssen, both of Germany

[73] Assignee: Novibra GmbH, Suessen, Germany

[21] Appl. No.: 08/707,484

[22] Filed: Sep. 19, 1996

[30] Foreign Application Priority Data

Oct. 3, 1995 [DE] Germany ..... 195 36 874

[51] Int. Cl.[6] ..... D01H 7/08

[52] U.S. Cl. ..... 57/135; 57/132; 384/228; 384/229; 384/230; 384/239

[58] Field of Search ..... 57/133, 134, 135, 57/136; 384/226, 227, 228, 229, 230, 231, 233, 234, 239

[56] References Cited

U.S. PATENT DOCUMENTS

| | | | |
|---|---|---|---|
| 2,657,524 | 11/1953 | Westall | 57/135 |
| 2,699,033 | 1/1955 | Bell | 57/135 |
| 3,049,860 | 8/1962 | Beerli | 57/135 |
| 3,065,593 | 11/1962 | Westall et al. | 57/135 |
| 3,798,888 | 3/1974 | Mandl | 57/135 |
| 4,997,291 | 3/1991 | Braxmeier et al. | 57/135 X |
| 5,092,115 | 3/1992 | Stahlecker et al. | 57/135 X |
| 5,201,170 | 4/1993 | Stahlecker et al. | 57/135 X |
| 5,359,842 | 11/1994 | Braxmeier et al. | 57/135 X |
| 5,528,892 | 6/1996 | Pesek et al. | 57/135 |

FOREIGN PATENT DOCUMENTS

| | | | |
|---|---|---|---|
| 2114779 | 8/1972 | Germany . | |
| 4004046 | 8/1991 | Germany | 57/135 |
| 503283 | 4/1939 | United Kingdom | 57/135 |
| 845669 | 8/1960 | United Kingdom | 57/135 |

OTHER PUBLICATIONS

Suessen–Novibra Technical Information on NASA–FIT HP–S 68 Spindle Bearing, Sep. 1995.

*Primary Examiner*—William Stryjewski
*Attorney, Agent, or Firm*—Evenson McKeown Edwards & Lenahan PLLC

[57] ABSTRACT

In the case of a spindle for spinning or twisting machines, two housings, separated by an annular gap, are provided, namely an outer housing, secured to a spindle rail, and an inner housing which takes up the neck bearing and the step bearing for the shaft by means of supporting parts. The inner housing is connected to a supporting portion by a flexible joining piece, which supporting portion is adjustable and clampable onto the bottom surface of the outer housing. The bottom surface takes at least approximately the shape of a ball cup, whose center point is at most 30 mm away from the upper edge of the outer housing in vertical direction.

19 Claims, 5 Drawing Sheets

SPINDLE FOR A SPINNING OR TWISTING MACHINE

BACKGROUND AND SUMMARY OF THE INVENTION

The present invention relates to a spindle for spinning or twisting machines comprising a shaft rotatably supported in a neck bearing and a step bearing, also comprising an outer housing securable to a spindle rail as well as an inner housing which takes up the neck bearing and the step bearing by means of supporting parts. The inner housing is separated from the outer housing by an annular gap and is connected to a supporting portion by means of a resilient joining piece, which supporting portion is disposed adjustable and clampable on a bottom surface of the outer housing.

In the case of a spindle of this type (U.S. Pat. No. 3,798,888) the inner housing is joined to the outer housing in the area of the neck bearing and also in the area of the step bearing in each case with a radially symmetrical metal spring. The inferior metal spring is fixed into a circular disc-like supporting portion, which is disposed radially adjustable and axially clampable with its plane surface on the likewise plane bottom surface of the outer housing. The inner housing can thus be adjusted in relation to the outer housing, whereby the angle of the spindle shaft is adjustable in relation to the vertical. When the inner housing is adjusted in relation to the outer housing, a swivel point is inevitably provided by the metal spring arranged at the neck bearing.

It is an object of the present invention to create a possibility for adjusting the spindle when the swivel point between the inner housing and the outer housing is not given by a spring.

This object has been achieved in accordance with the present invention in that the bottom surface takes at least approximately the form of a ball cup, whose center point is at most 30 mm away from an upper edge of the outer housing in a vertical direction.

Due to the shape of the ball cup, the swivel point (center point of the ball cup) around which the inner housing can be adjusted in relation to the outer housing is established even without a radially elastic spring arranged in the area of the neck bearing. The spring element in the area of the neck bearing can therefore be omitted, as one single, resilient spring element underneath the step bearing is sufficient. As there is one less joining point between the inner housing and the outer housing, the noise transmission path is reduced, which results in an improved noise damping of the spindle overall.

The choice of the center point of the ball cup in the area of the upper edge of the outer housing has as a consequence that the inner housing stands continuously centrical to the outer housing, at that point where during operation the spindle demonstrates the greatest radial displacement of the inner housing as a result of forces of imbalance. Thus there is a reduced risk that the inner housing will strike the outer housing during operation of the spindle. The choice of the center point results further in a higher exactness in adjusting the spindle.

Although the arrangement of the center point in the area of the upper edge of the outer housing is desirable, there is a certain range within which the desired effect is still achieved. Outside of this range of 30 mm, either over or below, several disadvantages arise. If the center point of the ball cup is too far below the upper edge of the outer housing, the annular gap located between the inner housing and the outer housing can become eccentric during adjusting of the supporting portion, whereby the annular gap is reduced on one side at its critical point, which leads to the danger of a crash stop during spindle operation. If, on the other hand, the center point of the ball cup is too far above the upper edge of the outer housing, the path of adjustment of the spindle shaft during centering of the spindle will be too short.

It is not absolutely necessary that in the case of the ball cup, a spherical surface is involved. Rather, in an embodiment of the invention, the ball cup can approximate a conical surface. The conicity of the conical surface is then predetermined for the purpose so that the conical surface is, at the line where the supporting portion is disposed on the bottom surface, a tangential surface to the ideal spherical surface. Thereby arises the advantageous swivel point for the inner housing also. In practical embodiments, the conicity of the conical surface lies between 4 and 7 degrees, preferably at approximately 55 degrees. A conical surface has the advantage over a spherical surface in that it is easier to make.

The ball cup is preferably the only support for the axial load transferred from the inner housing to the outer housing. This results not only in a good vibrational characteristic in the spindle, but also in the metal noise transmission path between the neck bearing and the spindle rail making the greatest possible detour. The present invention is based on the acknowledgement that the neck bearing is the source for most of the spindle noise and that the structure-borne noise coming from the neck bearing is transmitted to the large-surface spindle rail and radiates out with increased volume therefrom. This noise transmission path is reduced considerably by the features of the present invention.

In an advantageous embodiment of the present invention, a one-piece component is provided for transmitting the axial load, which component comprises the above mentioned supporting portion, the resilient joining piece in the form of a resilient bolt as well as a cylindrical insert pressed into the inner housing. This results in particular in an advantage in the manufacturing process in that the inner housing can, as required, be made as a tube with a constant diameter and constant wall thickness.

The adjusting of the inner housing in relation to the outer housing becomes particularly convenient when the ball cup is provided with a centrical bore hole, through which a bolt-like extension of the supporting portion can be guided with clearance, which extension is provided with a working surface for a machine tool. After a fastening nut has been loosened, the inner housing can, for example, then be adjusted relative to the outer housing by a machine tool. In this position it is then fixed securely again. Centering can be carried out in this way while the spindle is in operation. It is not necessary to loosen the outer housing from the spindle rail.

The ball cup is secured against the supporting portion by a locking device. It is thus superfluous to secure the inner housing from the outside during adjustment against rotation with an additional machine tool. A sealing ring, pressed in between the inner housing and the outer housing and necessary in any case, can be advantageously used as a locking device. The frictional forces arising therefrom are completely sufficient, as tests have shown.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
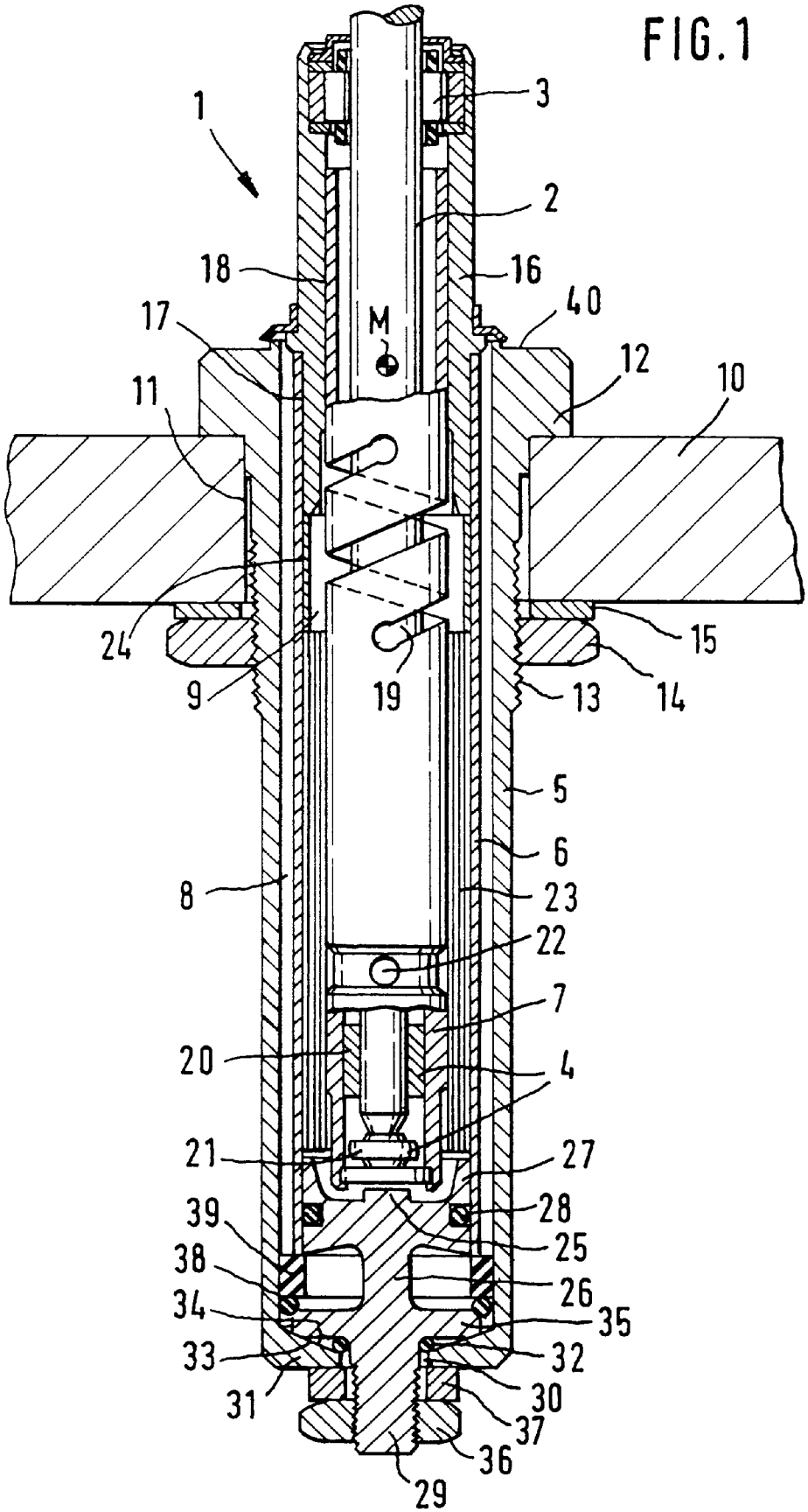
FIG. 1 is a longitudinal section through a spindle of a spinning or twisting machine with a spindle shaft support assembly constructed according to a first preferred embodiment of the present invention.

The spindle 1 shown in FIG. 1 comprises a rotatably mounted shaft 2, which is supported in an upper neck bearing 3 and in a lower two-part step bearing 4.

The spindle 1 comprises three tube-shaped components arranged inside one another, of which the outer component is a relatively thick-walled outer housing 5, preferably made of an aluminum alloy; the middle component is an inner rousing 6 supporting at least indirectly the neck bearing 3 and the step bearing 4, while the inner component is a resilient centering tube 7. Between the outer housing 5 and the inner housing 6 there is an outer annular gap 8, and between the inner housing 6 and the centering tube 7 there is an inner annular gap 9.

The outer housing 5 is fastened to a spindle rail 10 which extends in a machine longitudinal direction without the use of any elastomer elements. For this purpose, the spindle rail 10 comprises at every spinning or twisting station a cylindrical bore hole 11, through which a respective outer housing 5 is placed from above in a short snug fit. The outer housing 5 is disposed from above with a flange 12 on the spindle rail 10. Underneath the spindle rail 10, the outer housing 5 is provided with an external screw thread 13 for taking up a fastening nut 14. After a washer 15 has been added between the fastening nut 14 and the flange 12, the outer housing 5 is braced with the spindle rail 10.

In the upper area of the inner housing 6, a bearing insert 16 is pressed in with a press fit 17. The tube-shaped bearing insert 16 in turn supports the neck bearing 3.

The upper part of the rotating shaft 2 projects out of the bearing insert 16, which shaft 2 serves in this area to take up a winding tube (not shown). The upper part (not shown) of the spindle 1 is connected to a drive wharve, on which a tangential belt, extending continuously in longitudinal machine direction for the purpose of driving the shaft 2, is disposed. The arrangement is such that the tangential belt lies in the area of the neck bearing 3, which thus indirectly takes up the belt pressure.

The resilient centering tube 7 is locked in a fixed point 18 underneath the neck bearing 3 in the bearing insert 16. The resilience of the centering tube 7 is achieved by means of a helical slit 19. In the lower area, the centering tube 7 supports a step bearing bush 20, which serves to take up the radial forces of the step bearing 4. Furthermore, the centering tube 7 supports a thrust plate 21, which takes up the axial forces of the shaft 2.

The step bearing 4 is oiled, whereby the step bearing bush 20 is provided with longitudinal bore holes for letting the oil run through. In addition, the centering tube 7 is provided in its lower area with a plurality of oil bore holes 22, which connect the inner annular gap 9 with the interior of the centering tube 7. Between the centering tube 7 and the inner housing 6 there is a damping spiral 23, which supports the centering tube 7 against the inner housing 6 and which is connected to the oil. The damping spiral 23 is supported at the bearing insert 16 through a spacer tube 24.

Underneath the thrust plate 21, there is a safety stop 25, which during normal operation has no contact with the step bearing 4.

Underneath the step bearing 4, the inner housing 6 is connected by a bolt-like resilient joining piece 26 to the outer housing 5. This joining piece 26 graduates upwards into a cylindrical insert 27, which is pressed together with a sealing ring 28 from below into the inner housing 6. A bolt-like extension 29 is formed by direct extension of the resilient joining piece 26, which extension 29 is guided with large clearance through a centrical bore hole 30 of the bottom 31 of the outer housing 5. A further sealing ring 32 is provided between the bolt-like extension 29 and the bottom 31.

The bottom surface 33 of the outer housing 5 is formed as a ball cup 34, whose particular construction will be explained in more detail below with the aid of the following Figures. The center point M of the ball cup 34 is located on the axis of the shaft 2 at the level of the upper edge 40 of the outer housing 5. The center point M of the ball cup 34 should not be further away than 30 mm from the upper edge 40 of the outer housing 5, either upwards or downwards. This location of the center point M, which defines a pivot for the movement of the inner housing with respect to the outer housing, allows for relative pivotal movement of the inner housing with always a sufficient radial gap between the inner and outer housing to avoid their contacting one another.

A circular disc-like supporting portion 35, made in one piece with the joining piece 26, is disposed on the ball cup 34, preferably with a line contact. The ball cup 34 thus serves at the same time as the only support for the entire axial load which is transferred from the inner housing 6 to the outer housing 5. As a result of the clearance of the bolt-like extension 29 in relation to the centrical bore hole 30, the inner housing 6 can be adjusted in relation to the outer housing 5.

When the spindle 1 is in operation, the critical area is located on the upper edge 40 of the outer housing 5, as the entire inner housing 6 is flexibly fixed only in the area of the resilient joining piece 26. Care must thus be taken that the inner housing 6 or the bearing insert 16 pressed therein does not crash stop against the inner wall of the outer housing 5. The selection of the center point M of the ball cup 34 ensures that the annular gap 8 remains constantly centric, even in the area of the upper edge 40 of the outer housing 5, when the inner housing 6 is adjusted. Thus it is not to be feared, after the spindle 1 has been adjusted, that the annular gap 8 becomes eccentric in the area of the upper edge 40 of the outer housing 5 thus leading to operational failure due to crash stops.

The adjusted position of the inner housing 6 is secured by a fastening nut 36, which is screwed onto an external thread of the bolt-like extension 29. The relevant washer 37 can be provided with working surfaces for a machine tool for adjusting the inner housing 6. After adjustment, the adjusted position is secured by fastening the supporting portion 35 to the ball cup 34 by means of a fastening nut 36.

The inner housing 6 is supported from below on the supporting portion 35 by an holding-down device 39, and with the intermediate aid of a further sealing ring 38. The holding down device 39 has the effect of an anti-rotation device when the inner housing 6 is adjusted. It is therefore superfluous to secure the inner housing 6 against turning during a centering process by means of an additional tool from outside.

The reference numbers used for the embodiment shown in FIG. 1 are retained as the last two numerals of the three-digit reference numbers in the following descriptions of embodiments, insofar as components with the same function are involved. Each first numeral of the three-digit reference numbers refer to the relevant drawing. For example, the inner housing 6 of FIG. 1 corresponds to the inner housing 206 of FIG. 2 and the inner housing 306 of FIG. 3 and so on. A repeat description of most of the components is omitted, insofar as this is dispensable.

Figure 2:
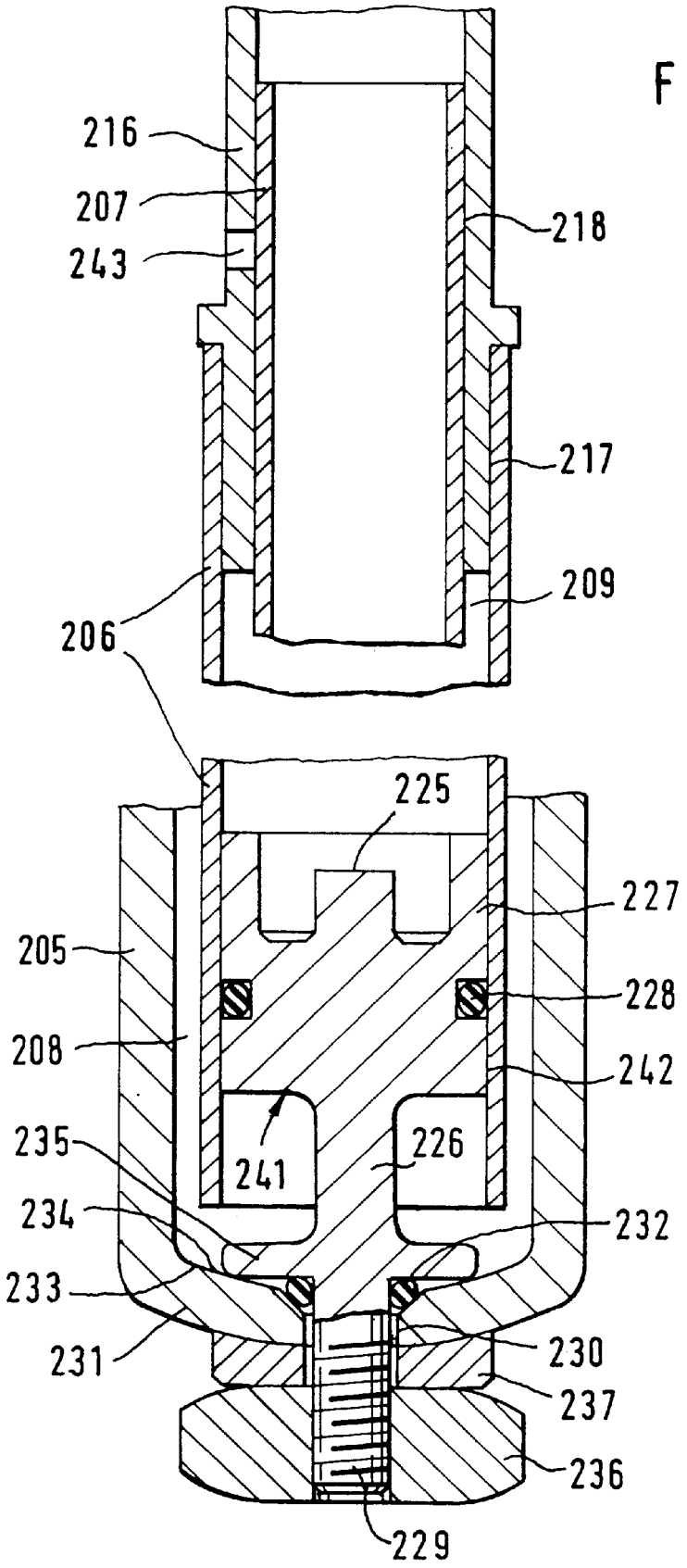
FIG. 2 is an enlarged sectional view showing details of another preferred embodiment of a spindle shaft support assembly for a spindle system otherwise similar to that shown in FIG. 1.

In the embodiment in FIG. 2, the ball cup 234 is formed as a section of a spherical surface. The supporting portion 235 disposed on the ball cup 234 is made together with the bolt-like extension 229, the resilient joining piece 226 as well as the cylindrical insert 227 to form one single component 241. This component 241 is pressed from below into the inner housing 206. The press fit 242 can be additionally secured by laser welding as required. The sealing rings 228 and 232 ensure that the interior of the inner housing 206 does not come into contact with the annular gap 208 between the inner housing 208 and the outer housing 205. The annular gap 208 is thus sealed off in an oilproof way against the interior of the inner housing 206. While the interior of the inner housing 206 is covered by oil, the outer annular gap 208 can be filled with a damping grease or with another highly viscous medium, for example silicon oil.

The embodiment in FIG. 2 corresponds otherwise to a large extent to that in FIG. 1.

The bearing insert 216 pressed into the inner housing 206 possesses a characteristic feature; in the area of its press fit 217 it is provided with a traverse hole 243. By means of a bolt-like tool, which can be placed into the traverse hole 243, the inner housing 206 can be prevented from turning when it is centered in relation to the outer housing 205 after the fastening nut 236 has been loosened.

Figure 3:
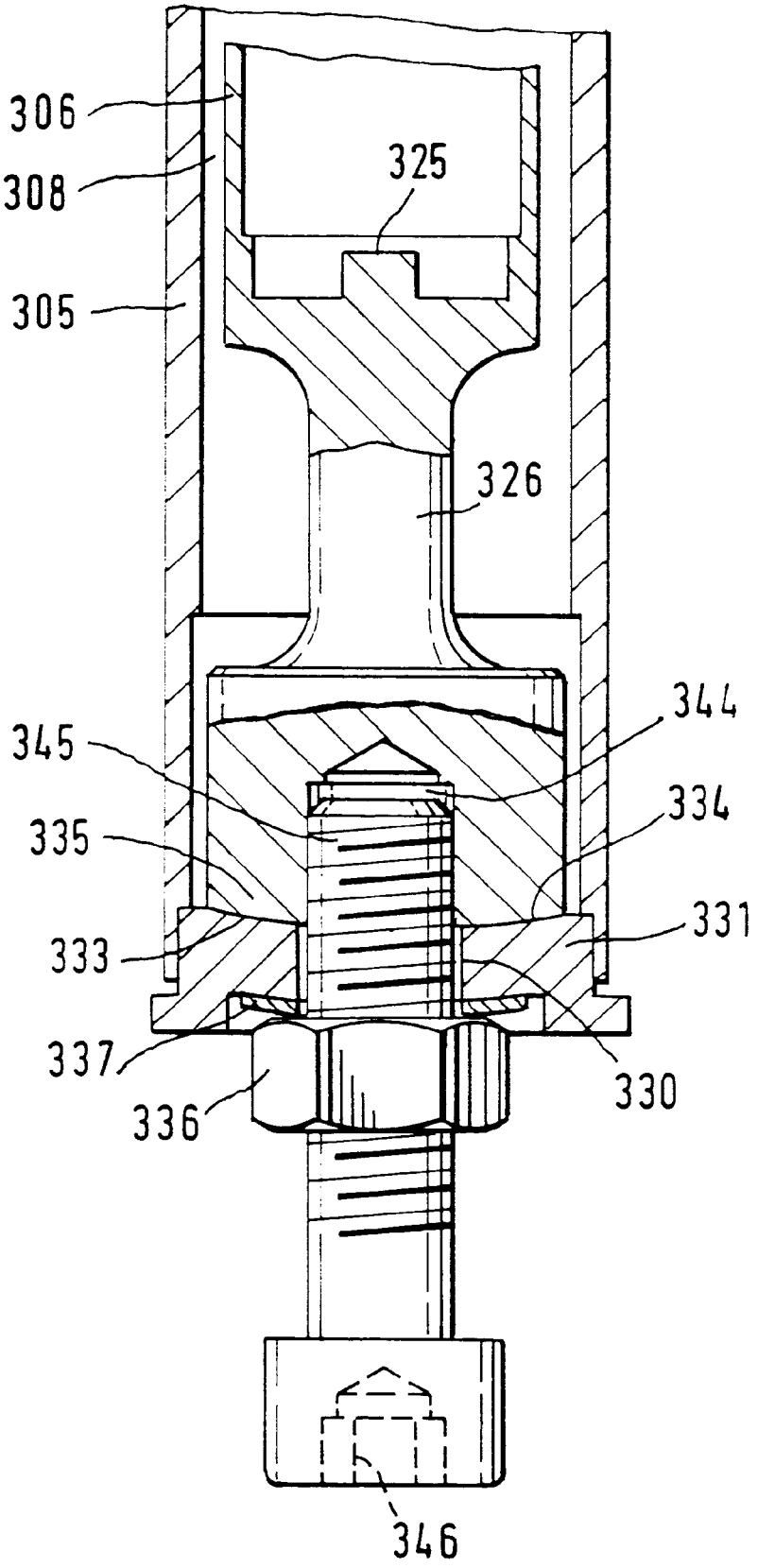
FIG. 3 is an enlarged sectional view showing details of a lower portion of another preferred embodiment of a spindle shaft support assembly for a spindle system otherwise similar to that shown in FIG. 1.

In the embodiment in FIG. 3, the resilient joining piece 326 is made in one piece with the inner housing 306. In this case, however, the bottom 331 of the outer housing 305 is a separate component. The bottom surface 333 is again provided with a ball cup 334, on which the supporting portion 335 is disposed over a large surface area. The supporting portion 335 has from below a centrical bore hole 334 with an interior thread, into which an adjusting screw 345 is screwed from below. By means of this adjusting screw 345, the bottom 331 is connected to the supporting portion 335.

After the fastening nut 336 has been released, the adjusting screw 345, together with the inner housing 306, can be adjusted in relation to the outer housing 305. The fixed position is then secured by screwing down the fastening nut 336. The adjusting screw 345 itself is provided on its head with a hexagon socket 346.

Figure 4:
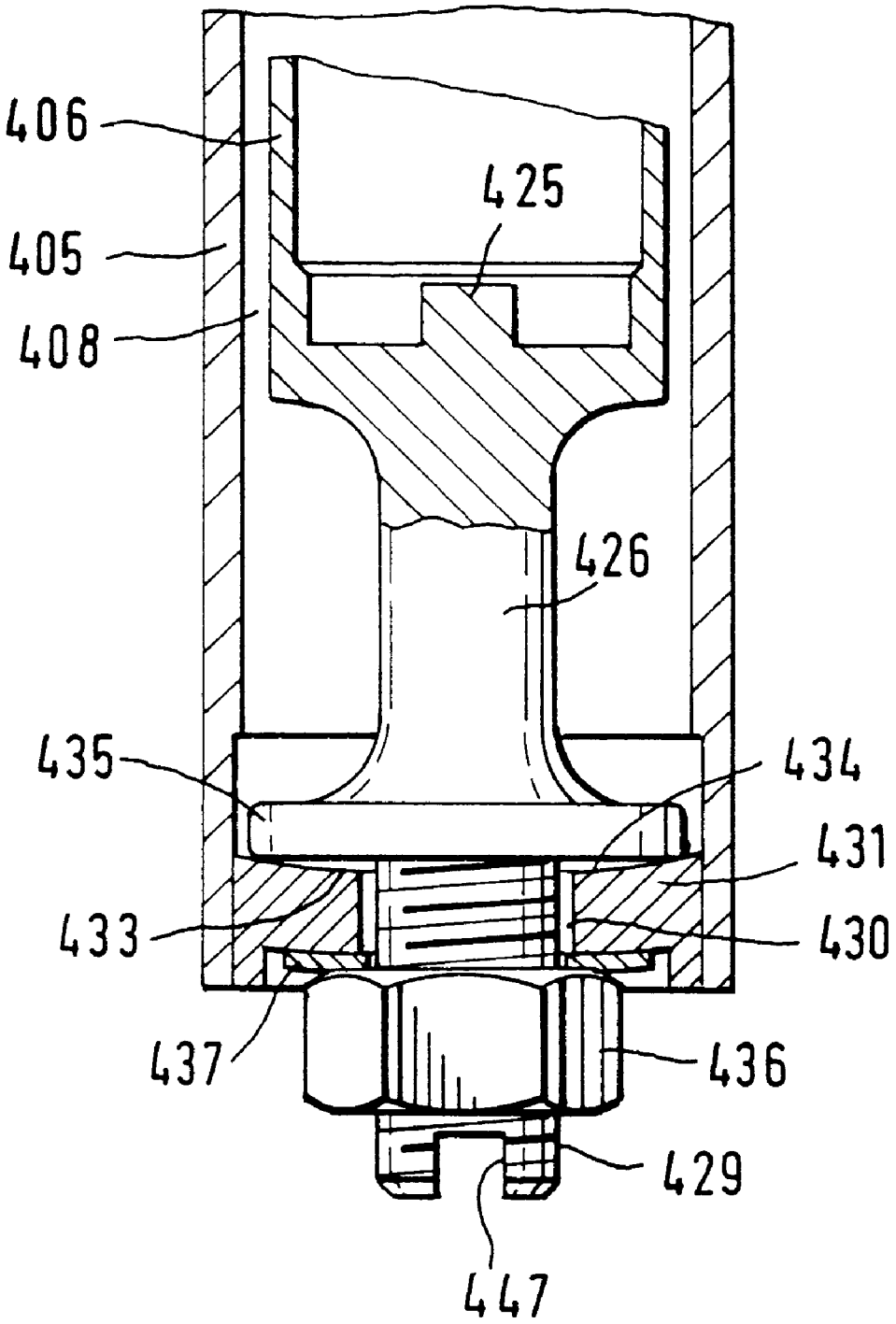
FIG. 4 is an enlarged sectional view showing details of a lower portion of another preferred embodiment of a spindle shaft support assembly for a spindle system otherwise similar to that shown in FIG. 1.

In the embodiment in FIG. 4 the resilient joining piece 426 is made in one piece with the inner housing 406 and the supporting portion 435. The bolt-like extension 429 is also formed thereto. Again a separate bottom 431 is set into the outer housing 405.

The ball cup 434 of the bottom surface 433 is approximated to a cone-shaped surface. The circular disc-like supporting portion 435 is disposed in a line on this cone-shaped surface.

The bolt-like extension 429 possesses a counter-hold 447 in the form of a recess. A tool can be placed in this counter-hold 447, with which tool the inner housing 406 is prevented from turning when being adjusted.

Figure 5:
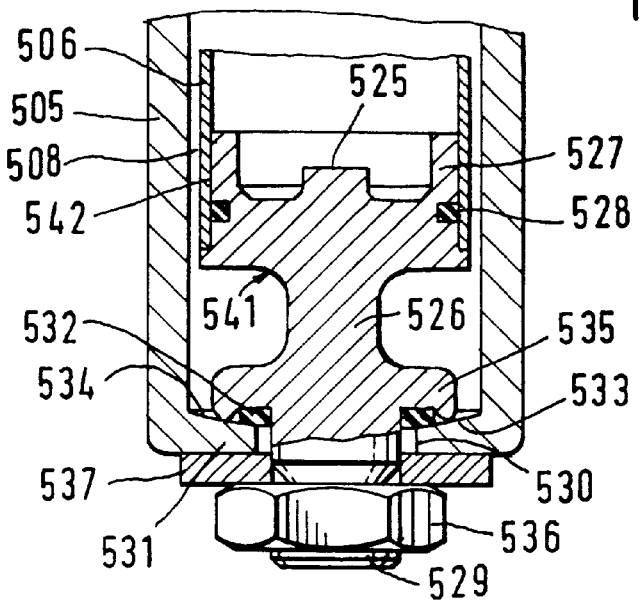
FIG. 5 is an enlarged sectional view showing details of a lower portion of another preferred embodiment of a spindle shaft support assembly for a spindle system otherwise similar to that shown in FIG. 1.

The embodiment in FIG. 5 corresponds to a great extent to that in FIG. 1. The cylindrical insert 527 is made in one piece with the resilient joining piece 526, the supporting portion 535 and the bolt-like extension 529 into a single component 541 and pressed into the inner housing 506 from below. The ball cup 534 is constructed as a cone-shaped surface.

The washer 537 is pressed securely onto the bolt-like extension 529, so that the tool can be placed on the washer 537, which is provided with working surfaces for the purpose.

The sealing ring 532 between the bottom surface 533 and the supporting portion 535 can be used as an anti-rotation device.

Figure 6:
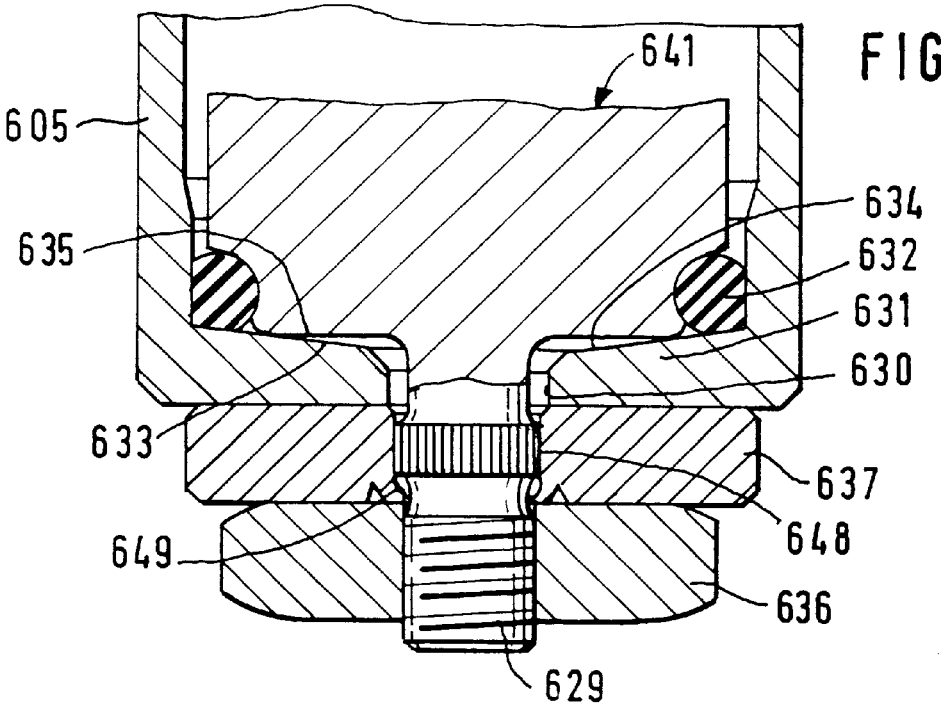
FIG. 6 is an enlarged sectional view showing details of a lower portion of another preferred embodiment of a spindle shaft support assembly for a spindle system otherwise similar to that shown in FIG. 1, including a preferred locking device between the inner housing and the outer housing.

The greatly enlarged embodiment in FIG. 6 shows clearly how a sealing ring 632 can function as an anti-rotation device between the supporting portion 635 and the bottom 631 of the outer housing 605, in that the sealing ring 632 is clamped in securely by both components. The frictional forces arising in circumferential direction therefrom have proven to be sufficient for an anti-rotation device.

The bolt-like extension 629 is provided with a knurled surface 648 in the area of the washer 637, so that the washer 637 is connected fixedly to the bolt-like extension 629. The washer 637 can thus serve as an adjusting disc during adjustment. After assembly the washer 637 is provided with a deformed section 649, which clamps into a circular groove and thus prevents the inner housing from being pulled upwards out of the outer housing 605. The latter aspect is important because the inner and the outer annular gaps can be filled with different damping media.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A spindle for spinning or twisting machines comprising a shaft rotatably supported in a neck bearing and a step bearing, also comprising an outer housing securable to a spindle rail, an inner housing which takes up the neck bearing and the step bearing by means of support components, which inner housing is separated from the outer housing by an annular gap and which is connected to a supporting portion by means of a resilient joining piece, which supporting portion is disposed adjustable and clampable on a bottom surface of the outer housing, wherein the bottom surface is a bearing surface configured to accommodate pivotal movement by relative sliding of the supporting portion with respect to the outer housing about a center point which is at most 30 mm away from an upper edge of the outer housing in the vertical direction, whereby adjusting movement of the axis of the inner housing with respect to the axis of the outer housing is facilitated.

2. A spindle according to claim 1, wherein the bottom bearing support surface approximates a cone-shaped surface.

3. A spindle according to claim 2, wherein the bottom bearing support surface is an exclusive support for an axial load transferred from the inner housing to the outer housing.

4. A spindle according to claim 3, wherein the supporting portion, the resilient joining piece in the form of a resilient bolt, and a cylindrical insert pressed into the inner housing are made together in one piece for the purpose of transferring the axial load.

5. A spindle according to claim 2, wherein the bottom bearing support surface is provided with a centrical bore hole through which a bolt-like extension of the supporting portion is guided with clearance, and wherein the extension is provided with working surfaces adaptable for cooperating with a machine tool.

6. A spindle according to claim 2, wherein the bottom bearing support surface is secured against the supporting portion by an anti-rotation device.

7. A spindle according to claim 1, wherein the bottom bearing support surface is an exclusive support for an axial load transferred from the inner housing to the outer housing.

8. A spindle according to claim 7, wherein the supporting portion, the resilient joining piece in the form of a resilient bolt, and a cylindrical insert pressed into the inner housing are made together in one piece for the purpose of transferring the axial load.

9. A spindle according to claim 8, wherein the bottom bearing support surface is provided with a centrical bore hole through which a bolt-like extension of the supporting portion is guided with clearance, and wherein the extension is provided with working surfaces adaptable for cooperating with a machine tool.

10. A spindle according to claim 8, wherein the bottom bearing support surface is secured against the supporting portion by an anti-rotation device.

11. A spindle according to claim 7, wherein the bottom bearing support surface is provided with a centrical bore hole through which a bolt-like extension of the supporting portion is guided with clearance, and wherein the extension is provided with working surfaces adaptable for cooperating with a machine tool.

12. A spindle according to claim 7, wherein the bottom bearing support surface is secured against the supporting portion by an anti-rotation device.

13. A spindle according to claim 1, wherein the bottom bearing support surface is provided with a centrical bore hole through which a bolt-like extension of the supporting portion is guided with clearance, and wherein the extension is provided with working surfaces adaptable for cooperating with a machine tool.

14. A spindle according to claim 13, wherein the bottom bearing support surface is secured against the supporting portion by an anti-rotation device.

15. A spindle according to claim 1, wherein the bottom bearing support surface is secured against the supporting portion by an anti-rotation device.

16. A spindle shaft support assembly for supporting a spindle shaft at a spindle rail, comprising:

an outer housing detachably disposable in a spindle rail through bore, an inner housing with spindle shaft bearing components, and a housing connection assembly resiliently connecting lower parts of said housings together while maintaining an annular gap between the inner and outer housing along a length thereof through the spindle rail through bore, said housing connection assembly including first and second clampingly engageable parts which are movable with respect to said outer housing to facilitate pivotal adjusting movement of said inner housing with respect to said outer housing about a pivot point, which pivot point is located within a predetermined minimal distance from an upper edge of said spindle rail when in an installed position to thereby accommodate pivotal adjusting movement of the inner housing with respect to the outer housing while preventing contact between said inner and outer housings along said annular gap.

17. A spindle shaft support assembly according to claim 16, wherein said first and second clampingly engageable parts form a partial spherical ball connection having a spherical center at the pivot point.

18. A spindle shaft support assembly according to claim 16, wherein said predetermined small distance is 30 mm.

19. A spindle shaft support assembly according to claim 17, wherein said predetermined small distance is 30 mm.

* * * * *